United States Patent [19]

Gamberini

[11] Patent Number: 4,947,872

[45] Date of Patent: Aug. 14, 1990

[54] METHOD FOR FORMING GROUPS OF FILTER CIGARETTES IN A PACKETING MACHINE

[75] Inventor: Antonio Gamberini, Bologna, Italy

[73] Assignee: G.D. S.p.A., Bologna, Italy

[21] Appl. No.: 69,404

[22] Filed: Jul. 1, 1987

[30] Foreign Application Priority Data

Jul. 15, 1986 [IT] Italy ..... 3463 A/86

[51] Int. Cl.[5] ..... A24C 5/35

[52] U.S. Cl. ..... 131/28.3

[58] Field of Search ..... 131/283

[56] References Cited

U.S. PATENT DOCUMENTS 3,750,676 8/1973 Kruse et al. ..... 131/283

4,627,450 12/1986 Focke et al. ..... 131/283

*Primary Examiner*—V. Millin

*Attorney, Agent, or Firm*—Ladas & Parry

[57] ABSTRACT

In a packeting machine, a method for forming groups of filter cigarettes in relative advancement pockets of a conveyor, each group consisting of a plurality of superposed layers fed in succession into the relative pocket by respective pushers; the method comprising exerting on each layer of cigarettes, during their entry into the pocket, two successive transverse compressive actions, the first of which causes the cigarettes to substantially approach each other transversely, and the second of which, more energetic than the first, is applied only to the filters, when the layer is nearing the end of its introduction into the pocket.

5 Claims, 3 Drawing Sheets

METHOD FOR FORMING GROUPS OF FILTER CIGARETTES IN A PACKETING MACHINE

This invention relates to a method for forming groups of filter cigarettes in a packeting machine.

In the description given hereinafter, the term "group of cigarettes" is used to indicate the cigarettes forming the contents of a packet and having the same arrangement as that which they assume within the finished packet. In general, each group of cigarettes comprises twenty cigarettes disposed in three superposed layers each composed of six or seven cigarettes.

Known packeting machines generally comprise an inlet hopper into which the cigarettes are fed in bulk transversely to their axes. For each of said layers, the hopper comprises an outlet mouth divided by inner baffles into a plurality of side-by-side channels equal in number to the number of cigarettes present in the relative layer.

Each layer is formed by gravity on a substantially horizontal wall disposed below the outlet end of the relative hopper mouth at a distance therefrom which slightly exceeds the diameter of a cigarette. Once formed, the said layer is urged by a pusher, parallel to the axis of the relative cigarettes, into a pocket of a conveyor which is driven stepwise transversely to the cigarette axis.

The introduction of a layer of cigarettes into an advancement pocket of the said conveyor requires certain technical problems to be solved, as the cigarettes must not only make point contact with a stop disposed at one end of the relative pocket without undergoing deformation or damage, but must also halt when in contact with said stop without rebounding, so as to give the group a perfectly ordered configuration when formed.

In known packeting machines, attempts have been made to solve the said technical problems in various ways, which have not always given completely satisfactory results. A first solution generally used to prevent the cigarettes continuing by inertia after the relative pusher has decelerated and/or stopped at the end of its insertion movement, and resulting in the cigarettes striking said stop violently and undergoing end deformation with rearward rebounding, has been to form said stop as an integral part of a counter-pusher which accompanies the pusher during its movement. This solution has not however given the desired results because the cigarettes, on termination of the insertion movement, undergo elastic compression by inertia against the counter-pusher, to become deformed at their end and rebound rearwards elastically as soon as the pusher leaves them.

It was subsequently attempted to eliminate the cigarette inertial movements relative to the pusher by applying a braking force to the cigarettes. For this purpose, each pusher is associated with two so-called "constraining elements", consisting of two bars disposed on opposite sides of the layer and parallel to the cigarettes thereof, to be moved towards each other during the insertion of the layer into said pocket so as to define a passage having a width slightly less than the width of the relative layer, to thus determine transverse compression of the cigarettes one against the other. In this manner, friction forces arise which tend to prevent axial advancement of the cigarettes under the thrust of the relative pusher, and to obstruct any inertial movement of the cigarettes relative to the pusher.

In practice it has been found that the transverse forces which need to be applied to the cigarettes by said constraining elements in order to completely eliminate said inertial movements of the cigarettes relative to the pusher exceed the forces which the cigarettes are able to withstand without deforming permanently and/or breaking.

The object of the present invention is to improve the aforesaid latter method in such a manner as to enable the cigarettes of each layer of each group to arrange themselves in a perfectly ordered and undamaged manner within the relative advancement pocket.

This is attained according to the present invention by a method for forming groups of filter cigarettes in a packeting machine, each said group being fed into a relative advancement pocket of a conveyor and consisting of a plurality of superimposed layers fed into said relative pocket by pusher means, the method being characterised by exerting on each cigarette layer during its entry into said pocket two different successive transverse compressive actions, the first of which causes said cigarettes of each said layer to substantially approach each other transversely, and the second of which, more energetic than the first, is applied only to said filters.

The invention is described hereinafter with reference to the accompanying drawings, which illustrate a non-limiting embodiment thereof, and in which:

FIGS. 1 and 2 show an inlet portion 1 of a cigarette packeting machine indicated overall by 2.

Figure 1:
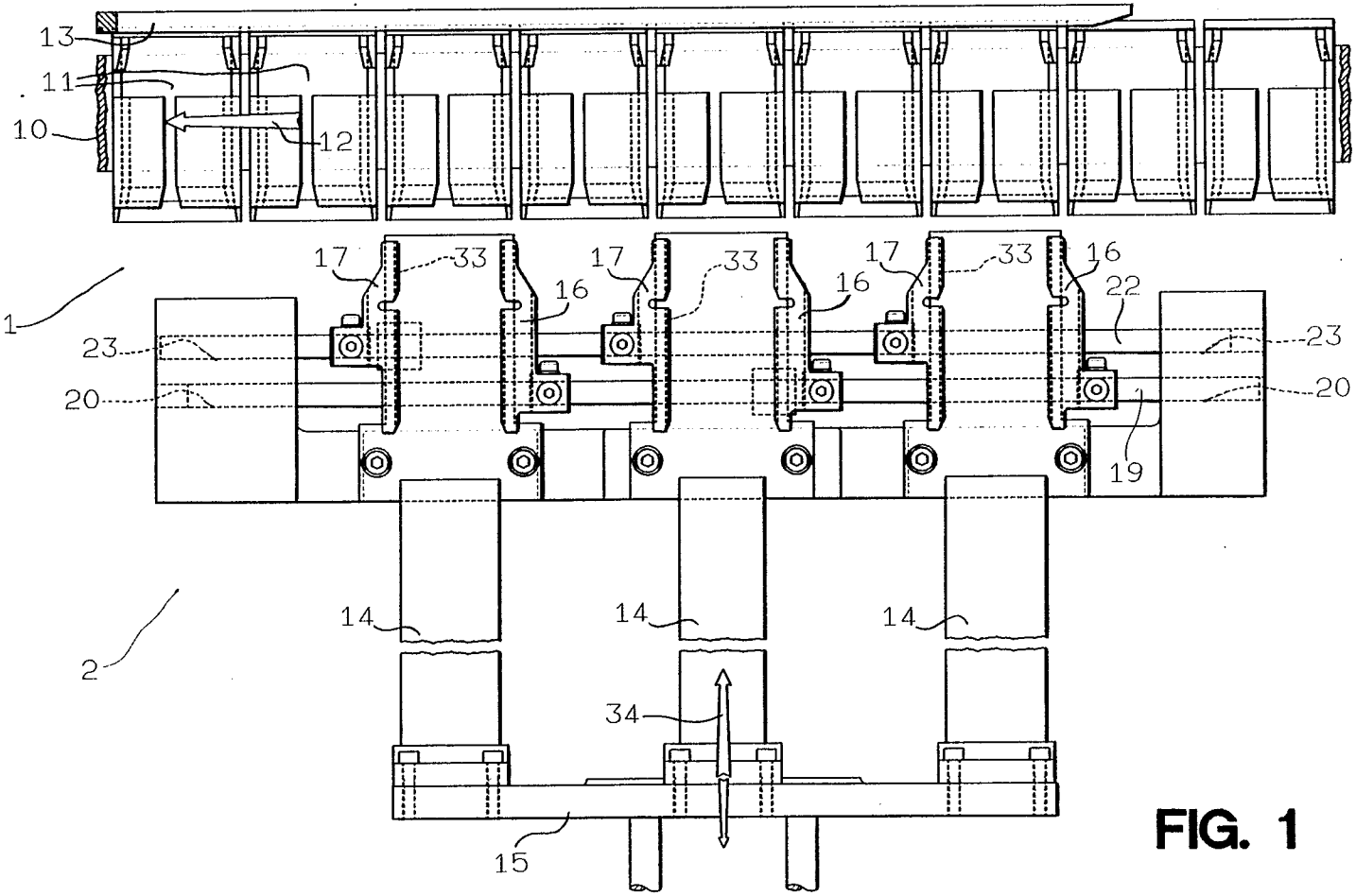
FIG. 1 is a plan view, with parts removed for clarity, of a detail of a cigarette packeting machine implementing the method according to the present invention.

The inlet portion 1 comprises an inlet hopper 3, the lower terminal outlet part of which consists of three downwardly tapering mouths 4, each of which comprises internal baffles or walls 5 which divide the relative mouth 4 into a plurality of channels 6.

As shown in detail in FIG. 2, cigarettes 7 disposed in a column advance along each channel 6 by gravity in a direction transverse to their axes, the lower cigarettes of each column lying in contact (see FIG. 2) with a plate 8 disposed below the relative mouth 4 at a distance therefrom which just exceeds the diameter of the cigarettes 7. On the plates 8, which are disposed at decreasing levels which differ from each other by a distance substantially equal to the diameter of a cigarette 7, there consequently form respective cigarette layers (FIGS. 3, 4 and 5) which are disposed at a level below the lower end of the relative mouth 4, namely between the relative plate 8 and the lower end of the mouth 4 itself.

The upper branch of a belt conveyor 10, driven stepwise by non-illustrated drive means and supporting uniformly distributed advancement pockets 11, extends laterally to the plates 8. Each pocket 11 extends transversely to the conveyor 10 drive direction indicated by the arrow 12 in FIG. 1, and is disposed with its inlet end facing the plates 8 and its opposite end substantially in contact with a fixed stop plate 13 extending parallel to the arrow 12.

Each pocket 11 is advanced by the conveyor belt 10 in such a manner as to stop in front of each of the plates 8 and receive in succession three layers 9 which become superposed inside said pocket 11 in order to form a group (not shown) of cigarettes 7 forming the contents of one packet (not shown).

Each layer 9 is fed into the relative pocket 11 by a respective pusher 14, which is rigidly connected to an operating cross-member 15 and is disposed, when in its retracted rest position, on the opposite side of the hopper 3 to the belt conveyor 10. Each pusher 14 moves with reciprocating motion between said retracted position and an advanced position in which the pusher 14 engages the space between the lower end of the respective mouth 4 and the respective plate 8, as shown in detail in FIGS. 2 to 5. When in its retracted position, each pusher 14 is disposed with its free end in contact with one end of a cigarette layer 9 which has just entered the relative pocket 11, and with its other end in contact with the wall 13.

During its movement between said retracted and advanced positions, each pusher 14 moves above the relative plate 8 and between two transverse pushers 16 and 17, these latter known as "constraining elements".

Figure 2:
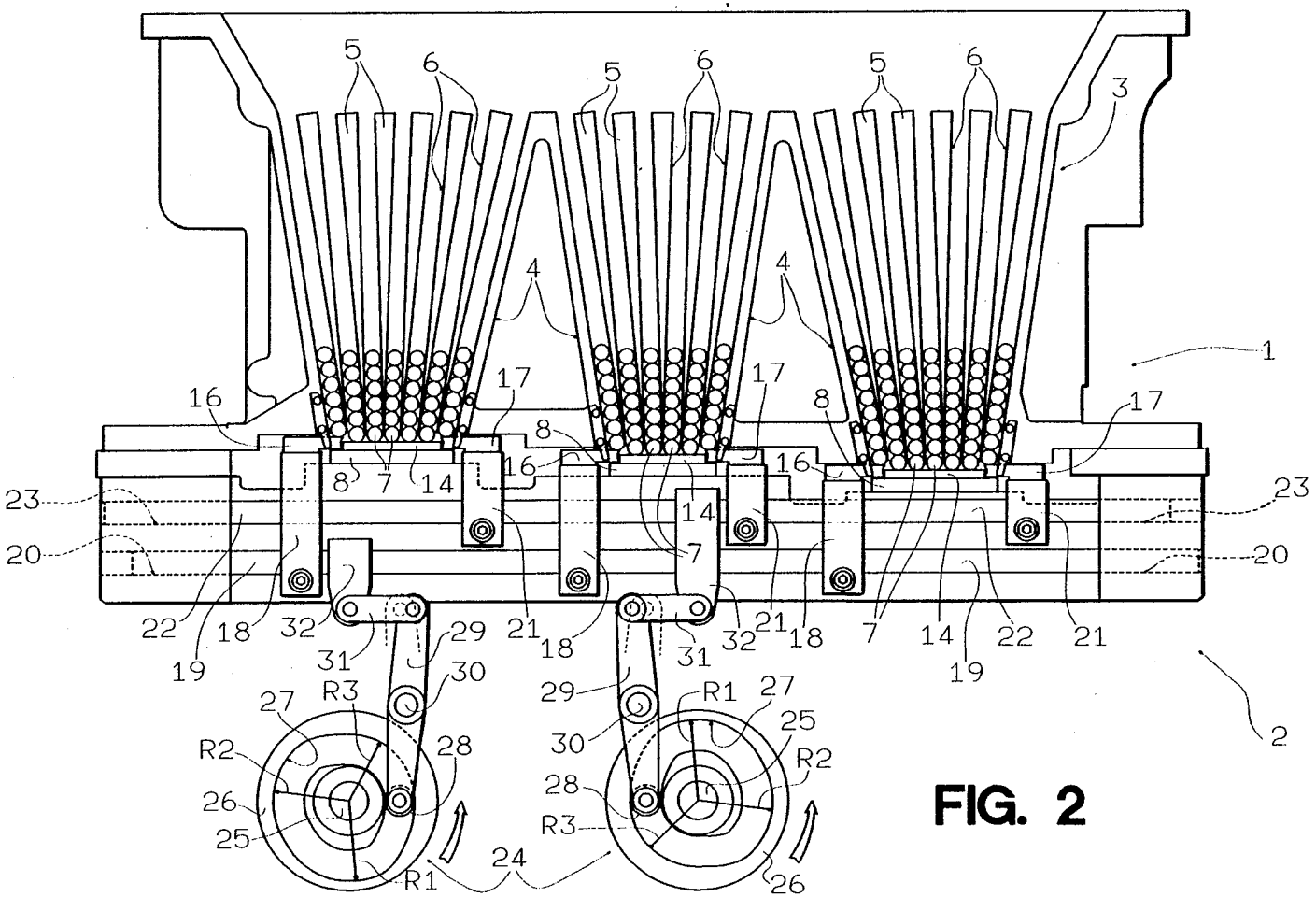
FIG. 2 is a side elevation of the detail of FIG. 1.
Figure 3:
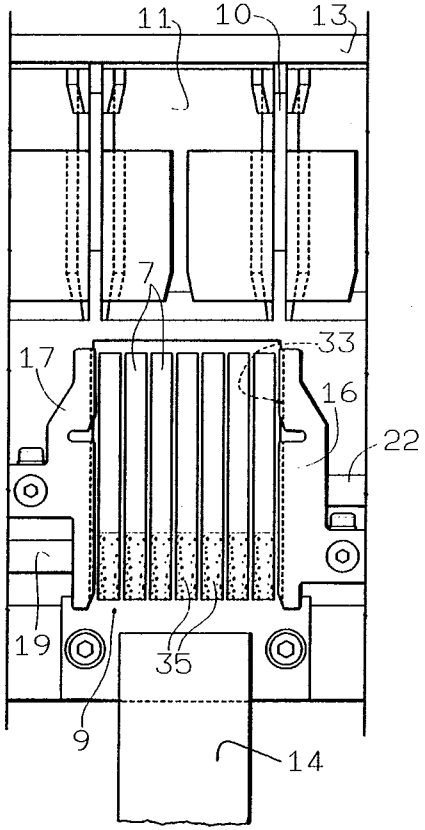

As shown in detail in FIG. 2, all the constraining elements 16 are rigidly connected to the upper ends of respective brackets 18 fixed along a shaft 19 which is parallel to the arrow 12 and is mounted axially slidable within respective end guides 20, whereas all the constraining elements 17 are rigidly connected to the upper ends of respective brackets 21 fixed along a shaft 22 which is parallel to the shaft 19 and is mounted axially slidably in respective end guides 23.

The shafts 19 and 22 are driven with axial reciprocating motion by respective drive elements 24, each of which comprises a drive shaft 25 disposed transversely to the shafts 19 and 22 and rotatable with continuous motion about its axis. On the drive shaft 25 there is keyed a frontal cam 26 comprising an annular groove 27 for guiding a follower roller 28 which is connected to the end of a rocker arm 29, an intermediate point of which is pivoted on a shaft 30 fixed parallel to the drive shaft 25.

The upper end of the rocker arm 29 is connected by a connecting rod 31 to the lower end of a bracket 32 rigidly connected to the respective shaft 19 or 22.

The groove 27 of each cam 26 comprises three successive portions which are joined smoothly together and have decreasing radii indicated by R1, R2 and R3.

In operation, when three successive pockets 11 of the conveyor 10 stop in front of the respective mouths 4 and the pushers 14 are operated simultaneously by the cross-member 15 so that each moves towards the space between the relative mouth 4 and the relative plate 8 in order to begin pushing the relative layer 9 towards the stop plate 13, the follower rollers 28 of the rocker arms 29 are each disposed along that portion of the respective cam 26 of radius R1. This position of the follower rollers 28 corresponds to the position of the constraining elements 16 and 17 shown in FIG. 3, in which each pair of constraining elements 16 and 17 defines a fixed feed channel 33 having a width substantially equal to the width of the relative mouth 4.

Figure 4:
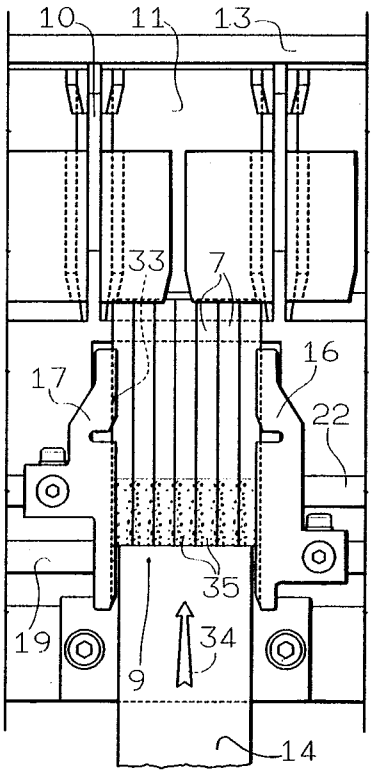

When, as shown in FIG. 4, the cigarettes 7 of each layer 9 have completely engaged the relative channel 33 and are about to commence engagement with the relative pocket 11 by virtue of the thrust of the relative pusher 14, the follower rollers 28 passes from the portion of radius R1 to the portion of radius R2 to cause each constraining element 16 and constringing element 17 associated therewith to approach each other by the action of the rocker arms 28 and shafts 19 and 22. In this first approached position, as shown in FIG. 4, the channel 33 defined by each pair of mutually associated constraining elements 16 and 17 has a width slightly less than the sum of the diameters of the cigarettes 7 of the relative layer 9. Thus over at least part of their advancement along the channel 33, the cigarettes 7 of each layer 9 are kept in lateral contact and slightly pressed against each other by the relative constraining elements 16 and 17.

Figure 5:
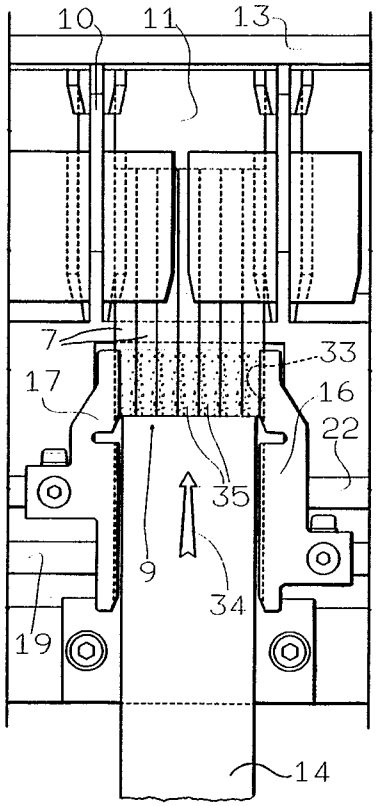
FIGS. 3, 4 and 5 are diagrammatic plan views to an enlarged scale of a portion of the detail of FIGS. 1 and 2 under three different operating conditions.

When, as shown in FIG. 5, the cigarettes 7 have penetrated for most of their length into the relative pockets 11, and practically only the filters 35 still engage the relative channels 33, the thrust movement of the cross-member 15 in the direction of the arrow 34 shown in FIGS. 1, 4 and 5 produces a deceleration action such as to progressively slow down the pushers 14 before they reach their end-of-stroke position corresponding to the position in which the cigarettes 7 are in contact with the stop plate 13.

Because of the slowing-down of the pushers 14, the cigarettes 7 would separate from them by inertia and would violently strike the stop plate 13 to undergo damage and rearward rebound if it were not for the action of the relative constraining elements 16 and 17 which keep them continuously in contact with the pushers 14 to enable them to progressively slow down until they stop in contact with the plate 13.

For this purpose, when the cross-member 15, continuing to move in the direction of the arrow 34, begins to decelerate and only the filters 35 of the cigarettes 7 engage the relative channels 33, the follower rollers 28 pass into that portion of the respective cams 26 of radius R3, to cause each constraining element 16 and its constraining element 17 to further approach each other until they reach the position shown in FIG. 5, in which each pair of constraining elements 16 and 17 engages the filters 35 of the cigarettes 7 of the relative layer 9 to press them one against the other in a relatively energetic manner in order to generate such friction forces as to obviate the possibility of any inertial movement of the cigarettes 7 occurring relative to the pushers 14.

When the cigarettes 7 come into contact with the stop plate 13, the movement of the cross-member 15 is reversed and the follower rollers 28 pass into that portion of the respective cams 26 of radius R1, to remain in this portion until the cross-member 15 again moves in the direction of the arrow 34.

From the foregoing description it is apparent that as the movements of the shafts 19 and 22 are always equal and opposite, a single cam 26 provided with two grooves 27 could be used.

Alternatively, one cam 26 could be dispensed with, and the two shafts 19 and 22, only one of which would be controlled by the remaining 26, could be connected together by a rocker arm pivoted on its centre line.

What I claim is:

1. A method for forming groups of filter cigarettes in a packaging machine, each group being fed into a relative advancement pocket of a conveyor and consisting of a plurality of superposed layers fed into said relative pocket by pusher means, said method comprising the step of exerting on each layer of cigarettes during said layer's entry into said pocket two different successive transverse compressive actions, the first of which causes said cigarettes of each of said layers to substantially approach each other transversely, and the second of which is more forceful than the first and is applied only to said filters.

2. A method as claimed in claim 1, wherein each of said layers is fed into said relative advancement pocket along a feed channel defined laterally by two constraining elements which are mobile relative to each other in order to vary the transverse width of said channel and to apply said two transverse compressive actions.

3. A method as claimed in claim 2, wherein said first transverse compressive action is applied to said cigarettes of each of said layers while said cigarettes engage said feed channel for a length exceeding that of their filters, whereas said second transverse compressive action is applied to said cigarettes while only said filters of said cigarettes occupy said feed channel.

4. A method of packaging a group of cigarettes by feeding them in layers into a relative advancement pocket associated with a conveyor, said cigarettes having a major axis, said method comprising the steps of:

pushing a layer of cigarettes into a relative channel located next to said advancement pocket;

squeezing transversely to said major axis said cigarettes in said relative channel as said pushing action continues to push said layer of cigarettes from said channel into said pocket;

diminishing the force of said pushing action when a substantial portion of length of said cigarettes has entered said relative advancement pocket.

5. The method as claimed in claim 4 wherein said relative channel is comprised of two sides which are mobile with respect to one another to vary the width of said channel to accomplish said squeezing action.

* * * * *